US005871287A

United States Patent [19]

Boyanowski et al.

[11] Patent Number: 5,871,287

[45] **Date of Patent: *Feb. 16, 1999**

[54] EXTENDED RIBBON LIFE FOR IMPROVED BAR CODE PRINTING

[75] Inventors: Robert Edward Boyanowski, Montrose, Pa.; Michael Robert Brechko, Windsor, N.Y.; Ho Chong Lee, Boulder; Jack Louis Zable, Niwot, both of Colo.

[73] Assignee: International Business Machines Corporation, Armonk, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 542,372

[22] Filed: Oct. 12, 1995

[51] Int. Cl.[6] ..... B41J 2/30

[52] U.S. Cl. ..... 400/103; 400/124.04; 395/110

[58] Field of Search ..... 400/73, 74, 103, 400/104, 249, 703, 124.04; 101/93.04, 93.05; 395/107, 108, 110, 111

[56] References Cited

U.S. PATENT DOCUMENTS

| | | | |
|---|---|---|---|
| 5,092,695 | 3/1992 | Silverman et al. | 400/249 |
| 5,183,343 | 2/1993 | Tazawa et al. | 400/103 |
| 5,676,473 | 10/1997 | Wright, IV et al. | 400/103 |

FOREIGN PATENT DOCUMENTS

| | | | |
|---|---|---|---|
| 60-179286 | 9/1985 | Japan | 400/249 |
| 62-027168 | 2/1987 | Japan | 400/74 |
| 62-156978 | 7/1987 | Japan | 400/74 |
| 62-273864 | 11/1987 | Japan | 400/74 |
| 63-202489 | 8/1988 | Japan | 400/249 |
| 63-202490 | 8/1988 | Japan . | |
| 03-219990 | 9/1991 | Japan | 400/249 |

*Primary Examiner*—John Hilten

*Attorney, Agent, or Firm*—Saul A. Seinberg; Robert B. Martin

[57] ABSTRACT

Disclosed is an improved method, in an impact matrix printer, for extending print ribbon life when used in printing bar codes and for improving the quality of bar codes printed by the ribbon, the printer including a dot matrix print head having a plurality of print pins and print hammers. The printer includes a medium to receive printed indicia thereon, and a print ribbon intermediate the print head and the medium, and means for effecting relative movement between the print head, the medium and the print ribbon so as to position opposite the print head different portions of the medium from time to time when the printer is operational and printing and to position different portions of the print ribbon intermediate the print head and the medium at preselected times when the printer is operational and printing. As is shown, the method includes the steps of determining when, under normal operating conditions, the print ribbon should be replaced because of an increase in errors in reading the bar code printed by the printer, for example, the color density of the narrower width lines are too light. Two ways of increasing the density of selected bar code lines of print are disclosed: (1) increasing the number of PELS (Picture Elements) per inch of print in at least selected printed lines of bar code, or (2) impacting the same print lines a greater number of times to increase the color density of at least selected PELS. In this manner, the useful life of the printer ribbon for printing bar codes and the quality of bar codes produced by the ribbon is increased without incurring printer throughput loss.

2 Claims, 6 Drawing Sheets

EXTENDED RIBBON LIFE FOR IMPROVED BAR CODE PRINTING

BACKGROUND OF THE INVENTION

1. Field of the Invention

The present invention relates to a methodology for enhancing bar codes formed in an impact printer by increasing the density of selected print bars or lines, and increasing the efficiency of the printing operation by extending the useful life of the print ribbons. The enhancing methodology may occur with the insertion of a new ribbon into the printer, or may be commenced at or near the print ribbon's "end of life" stage. More particularly, the present invention relates to a methodology of printing bar codes wherein the vertical printing element (PEL) density is selectively increased and/or double strike or overstrike techniques are utilized to form readable bar codes while extending ribbon life.

2. Description of the Prior Art

In recent years, it has become increasingly important to print special symbols, such as bar codes, in an impact printer in a consistent, uniform, recognizable and economical manner. This is particularly true for use of today's ubiquitous bar codes which depict various codes through the use of combinations of parallel narrow and thick vertical lines separated by spaces between the lines. Accurate recognition of bar codes by scanners and similar reading devices starts with the printing device that creates the bar codes and it is, therefore, important that printers produce readable bar codes. However, as important as the creation of readable bar codes may be, the costs of printing and down time for ribbon changes must be considered against the problems created by unsatisfactory bar codes.

Typical bar code printing may be accomplished in a dot matrix impact line printer, in a thermal printer or in other non-impact printers. This invention is concerned with the use of an impact line matrix printer that employs a fabric ribbon to print bar codes. Many printers of this type utilize a ribbon drive having opposed spools located adjacent the ends of a printing zone. The print zone usually includes a platen to support print receiving medium (conventionally a paper product) on which printing is to occur and a shuttle which carries a print head comprising a plurality of individually actuable or energizeable print hammers disposed to strike the ribbon and press the ribbon portion adjacent the head and media against the print receiving medium. Depending upon the printer design, the shuttle is driven from one edge of the media to the other edge thereof. Motion to effect relative perpendicular medium displacement, relative to the print head and ribbon (in effect a line feed), occurs in a conventional manner, e.g. a medium drive motor.

During printing operations, the ribbon is rotatably driven from one spool to the other through the print zone. Upon sensing that the end of the ribbon has been reached, the ribbon direction is reversed and the ribbon is fed through the print zone in the opposite direction.

Although there are several types of ribbons that can be utilized in a line matrix printer, the present invention is concerned with the use of fabric ribbons or ribbons made of a material in which ink can freely migrate into previously impacted areas of the ribbon from adjacent areas. When overall ink depletion in such ribbons reaches a level where migration is no longer possible or insufficient ink remains to replenish what has been used, the ribbon is said to have reached end of life. Other factors, such as mechanical wear or the printer's operating environmental conditions, for example, can also affect ribbon life.

For purposes of printing bar codes, however, end of ribbon life is a function of the suitability of the bar codes being printed to be properly recognized by a bar code reader, which may change for the worse long before ribbon ink is depleted or mechanical wear affects the ribbon's bar code suitability. The amount of ink left in a ribbon or the expectation that the ink left will flow to ink depleted areas of the ribbon are relatively unimportant compared to the suitability of the bar codes being produced by a particular ribbon. Thus, ribbon life needs to be determined in a different manner when bar codes are to be printed.

There are several methods of determining ribbon condition with respect to printing of bar codes. In one approach, a counter is used to add up all print impacts and to trigger a "change ribbon" signal when the count reaches a predetermined number. See U.S. Pat. No. 5,092,695 to Silverman et al, "Printer Having Ribbon Wear Indicator" for some examples of this approach. An alternative scheme is described in Japanese Patent No. 61-32772 to Ueno, "Bar-Code Printing Apparatus" wherein a scanner reads and compares each bar code after it is printed to a standard bar code and flashes a ribbon replacement indicator when the two codes are sufficiently different. In yet another approach, the difference in contrast between the bar code lines and their interlineated spaces, is measured and the ribbon changed whenever print contrast falls below a reading of 2.0 ANSI grade and/or the print contrast signal falls below 0.70 PCS, levels at which bar code readings become questionable and error plagued when scanned. (The ANSI standard specifications for Bar Code are set forth in "Bar Code Print Quality Guide", ANSI X-3.182-1990(R1995)).

This low contrast problem is actually more pronounced with the single dot width narrow bars or lines of a bar code than they are with the wider multiple dot bars which have horizontal overlaps of their constituent adjacent dots. It has been found, when a low contrast condition of this type occurs, that most ribbons are still in reasonable and usable condition and have not incurred any permanent damage or ink depletion that would otherwise prevent their continued use for other than bar code purposes.

OBJECTS AND SUMMARY OF THE INVENTION

In view of the above it is a principal object of the present invention to provide a method for enhancing bar codes formed in an impact printer by increasing the density of selected print bars or lines, and increasing the efficiency of the printing operation by extending the useful life of the print ribbons employed in such a printing operation.

Another object of the present invention is to prolong the useful life of a dot matrix impact printer's ribbon for purposes of printing bar codes without falling below acceptable bar code contrast or ANSI grade levels although the ribbon may otherwise have been indicated to be marginal or ineffective for that purpose.

It is also an object of the present invention to prolong the useful life of a dot matrix impact printer's ribbon for purposes of printing bar codes without interfering with the non bar code portions of what is being printed.

Yet another object of the present invention is to prolong the useful life of a dot matrix impact printer's ribbon for purposes of printing bar codes without increasing thruput print times.

These objects of the present invention are accomplished by utilizing the two techniques and means described hereinafter. The first technique requires that the vertical PEL (Printing Elements) density, or dots per inch in this case, be increased from what is normally used to a higher level, preferably double, either before or at the time that the ribbon reaches the end of its useful life, however that is determined. The second technique maintains the vertical PEL density, but employs double strike or overstrike to achieve improved bar code print contrast, again, either before or at the time that the ribbon reaches the end of its useful life however that is determined. Means for implementing these techniques are also described.

Other objects, features and advantages, and a more complete understanding of the present invention will appear more fully from the following description and claims taken in connection with the accompanying drawings.

DETAILED DESCRIPTION OF THE PREFERRED EMBODIMENTS

Figure 1:
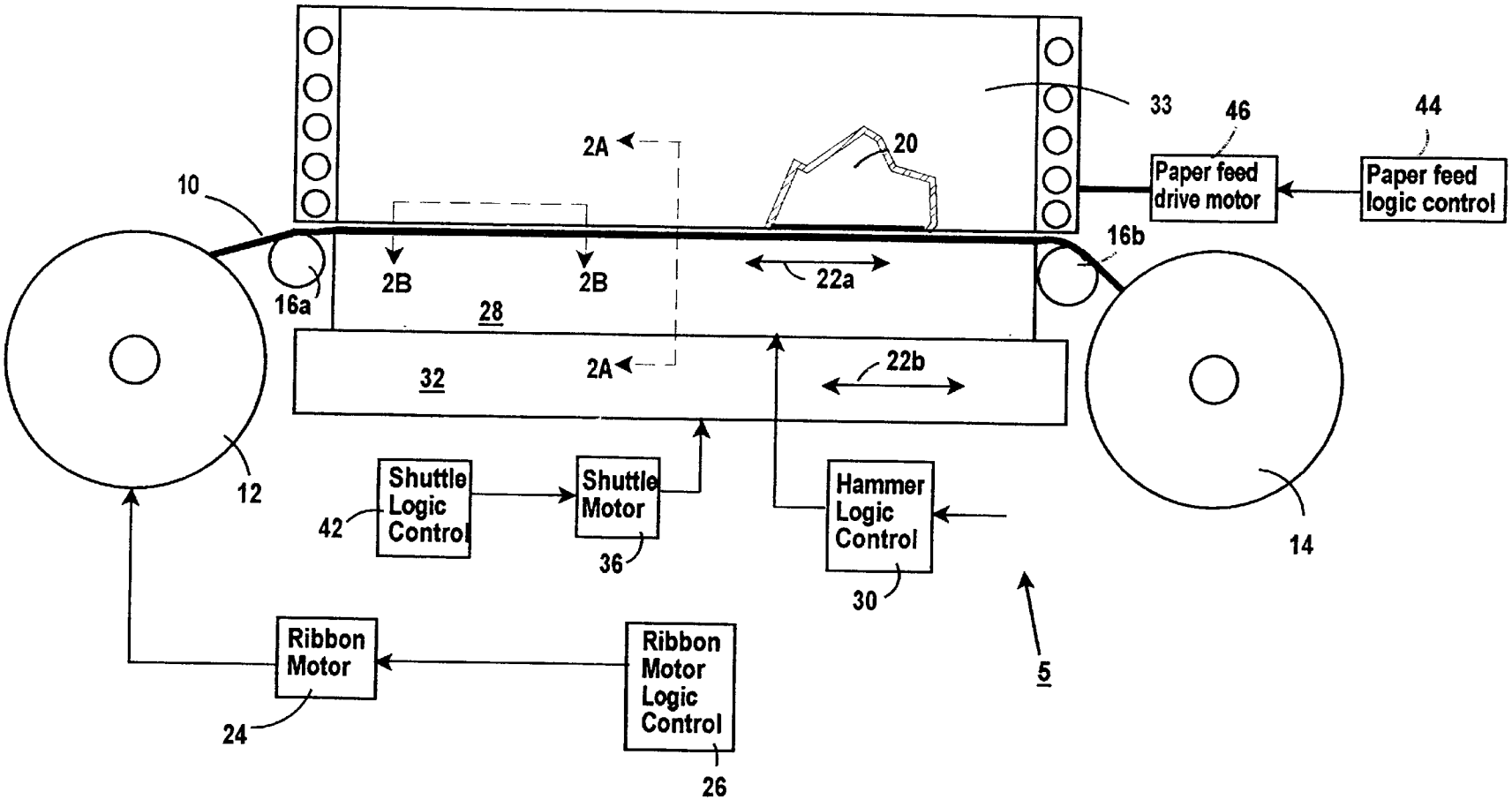
FIG. 1 a fragmentary schematic view of a typical line dot matrix printer in which bar code printing is accomplished and in which the present invention can be utilized.

Referring now to the drawings wherein like reference numerals have been used in the several views to identify like elements, FIG. 1 depicts, in a fragmentary schematic view, a typical line dot matrix printer 5 that can be used to print bar codes in accordance with the present invention. Actually, this type of printer is thought to be the most predominate one used in printing bar codes today. The IBM Models 6408 and 6412 line dot matrix printers are representative of such printers.

As shown in FIG. 1, a ribbon 10 is mounted on and between a source spool 12 and take-up spool 14 which can be reversed in function and direction.

The ribbon 10 is supported in part by a left and right guide 16*a* and 16*b*. The ribbon 10 is disposed, when mounted on spools 12 and 14, between a hammer or print head assembly 28 and a platen 20 generally defining a print zone in conjunction with print receiving medium 33.

As illustrated in FIG. 1, a motor 24 and ribbon motor drive logic control means 26 reversibly drive the ribbon between spools 12 and 14. The hammer or print head assembly 28 is mounted on a shuttle assembly 32 for reciprocating longitudinal movement as shown by arrows 22*a*, 22*b*. The shuttle assembly 32 is driven by a shuttle motor 36. The speed, position and direction of shuttle 32 are controlled by shuttle logic control means 42 in a conventional manner. In a similar manner, hammer logic control means 30 is connected to the hammer assembly 28 for controlling the timing, selection and "firing" of the individual hammers or solenoids 31 within the hammer assembly against pins 29 (see FIGS. 2A, 2B).

In operation, as implemented in the IBM 6408 printer, the ribbon motor drive logic control means 26 utilized to control the speed, direction of and drive the ribbon back and forth between spools 12 and 14, is conventional.

As set forth heretofore, the shuttle 32 reciprocates longitudinally along tracks (not shown) to drive the hammer assembly along a path adjacent a print receiving medium (e.g. paper) 33 on which printing is to occur. While the print receiving medium 33 (hereinafter paper) illustrated is of a fanfold, tractor feed design, the medium can be of any material which is capable of receiving an impact and printing as caused by a dot matrix impact line printer. As is also conventional, the paper 33 is driven generally perpendicular to the print ribbon 10 and the hammer assembly 28 and shuttle assembly 32 direction.

Paper feed, generally referred to as line feed, is under control of a paper feed logic control 44 connected to a paper feed drive motor 46.

To print, the information to be printed and the logic control and timing signals associated therewith are fed in an appropriate manner to the ribbon motor logic control means 26, the hammer logic control means 30, the shuttle logic control means 42, and the paper feed logic control means 44. These control means then respectively move the ribbon during the printing cycle to continuously place fresh portions thereof between the hammer assembly and the paper 33, move the shuttle assembly shuttle to properly position the hammer assembly 28 with respect to the paper 33 and energize the individual hammers of hammer assembly 28 to cause them to strike the ribbon 10 and paper 33 thereby printing the desired information on the paper 33 at the proper location.

Figure 2A:
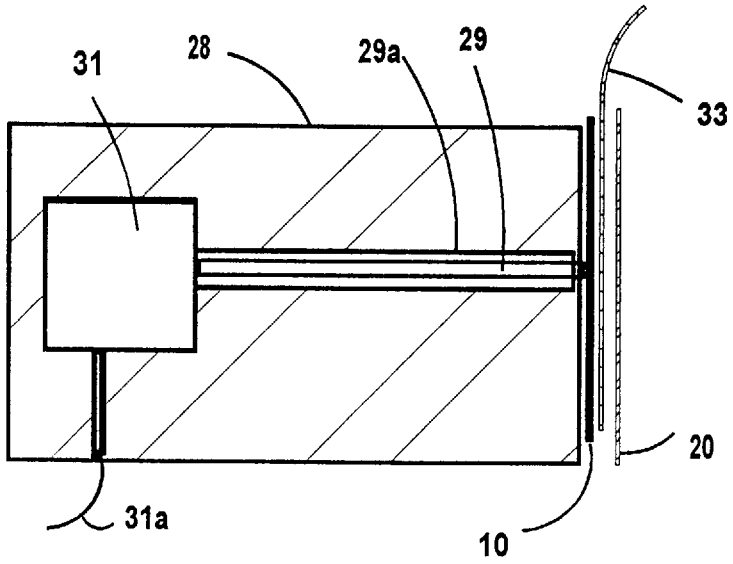
FIG. 2A is an enlarged, fragmentary sectional view taken along lines 2A—2A of FIG. 1 and illustrating schematically a portion of the hammer assembly illustrated in FIG. 1.
Figure 2B:
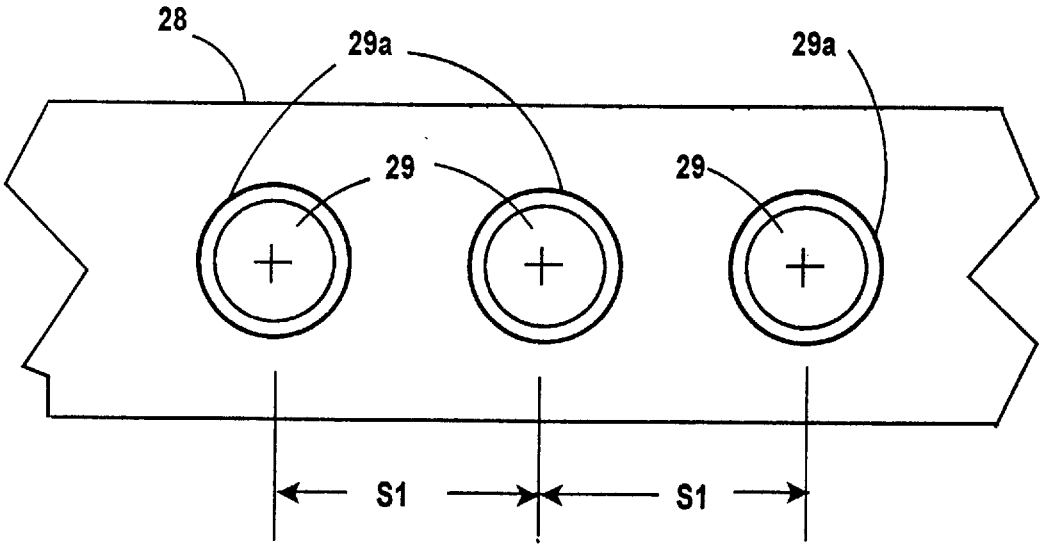
FIG. 2B is an enlarged, fragmentary view taken along lines 2B—2B of FIG. 1, with portions thereof removed for clarity, and illustrating schematically a portion of the hammer assembly illustrated in FIGS. 1 & 2.

In the illustrated instance, and referring now to FIG. 2A and 2B, the hammer assembly 28 includes a plurality of print hammers or solenoids 31 powered as through leads 31*a*, each solenoid is connected to a pin 29 mounted in a cylindrical cavity 29*a* and extending to a position adjacent the print ribbon 10. In some hammer units, the respective pins and solenoids are combined to comprise single subassemblies. The pins are positioned, in the IBM 6408 printer, in a single horizontal row, and as shown the print pins being spaced apart a distance S1. By way of example, in the IBM 6408 there are 44 pins and the print zone is considered to be 13.2" (33.528 cm.) Therefore, the hammer or print head assembly 28 pins 29 are arranged so that there are 44/13.2=

3.33 pins/inch (1.312 pins/cm) of head assembly. Thus, the pins are only 0.3 inches (S1=13.2/44) apart (7.62 mm). The shuttle 32 travels at a speed such that at the fastest firing rate, 60 dots per inch printing is achieved.

Thus, in a 72 by 120 DPI matrix printer, while 120 pin positions are addressable in a horizontal direction, there are a maximum of only 60 "dots" or pels (picture elements) capable of being printed in a single printer pass in a single row/inch. 60 dots per inch is typically used for text printing. With 60 pels the diameter of a pin is then only 1/60" or 0.0167" (0.423 mm). Inasmuch as the pins are only 0.3" apart, (~3 pins/inch), each pin must be capable of printing 18 PELS per pass, and the shuttle 32 and hammer or print head assembly 28 need be capable of moving slightly more than 0.3 inches (~7.62 mm) to print a single horizontal line of dots with a density of 60 pels/inch.

In order to achieve a 120 PEL horizontal density when desired, and since the pins are addressable on 1/120" centers, but printable on only 1/60" centers, the shuttle or head assembly reciprocates and prints in both directions. Thus, two passes of the shuttle 32 are required. (By way of example, a pin cannot be addressed such that if it prints a first PEL, the shuttle 32 moves the head assembly 1/120" and then the same pin is fired again to create a half pin diameter overlap.) The rule is simply stated. In one pass of any pin, it cannot print adjacent addressable PEL locations. The way that continuous dots at 120 PEL density is achieved is by having the head assembly 28 reciprocate to form two passes of the pin over any addressable location, before a line feed is initiated by the paper feed logic control 44 and paper feed drive motor 46. It should be noted that 120 dots per inch can be achieved by slowing the shuttle 32 down to half speed. However, this reduces the printing rate or thruput when text is to be printed at the usual 60 PELS per inch. It should be recognized, that the above scheme is only by way of example and other machines may have increased PEL density with smaller pin wire size and direct, adjacent address printing. Additionally, if higher addressability is available, say, 180 PEL/inch, 240 PEL/inch, etc., then 3 and 4 shuttle passes, respectively, must be made to complete a dot row.

In a 72 PEL/inch (28.35 PELS/cm) vertical print density scheme, and by way of example only, on center spacing Vs for a single line of vertically disposed PELS such as the line 50, (see FIG. 4) is ~0.014" or 0.353 mm. Inasmuch as the pin diameter Pd is 0.0167 inches, about a 15% PEL area overlap occurs when a single bar or vertical line of PELS is printed to create the thin bar or line of print 50 in bar code printing. As may be readily understood, the paper feed logic control 44 causes the paper feed motor 46 (conventionally a fine step stepping motor) to increment one step of a vertical distance Vs (or in the example, 1/72") every other hammer or print head assembly pass. In this manner full addressability of the print head is effected.

Figure 3:
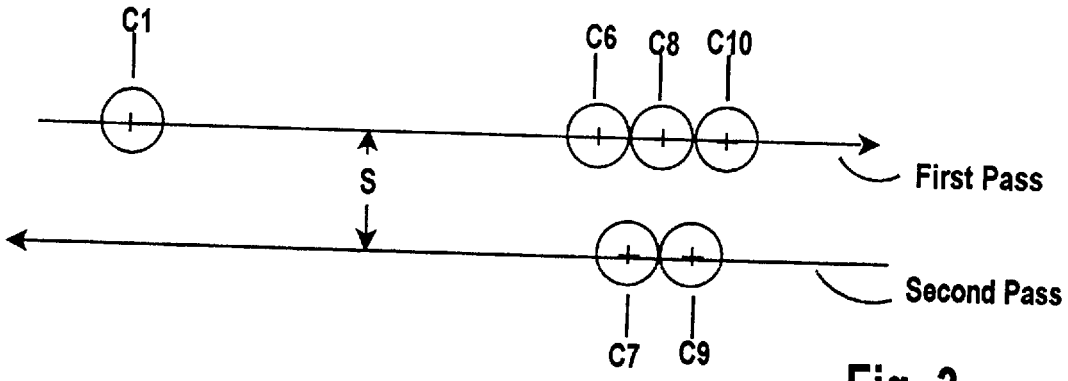
FIG. 3 is a diagrammatic representation of the manner in which bar coding was accomplished with prior art print ribbon utilization methods in the printer of FIG. 1.
Figure 4:
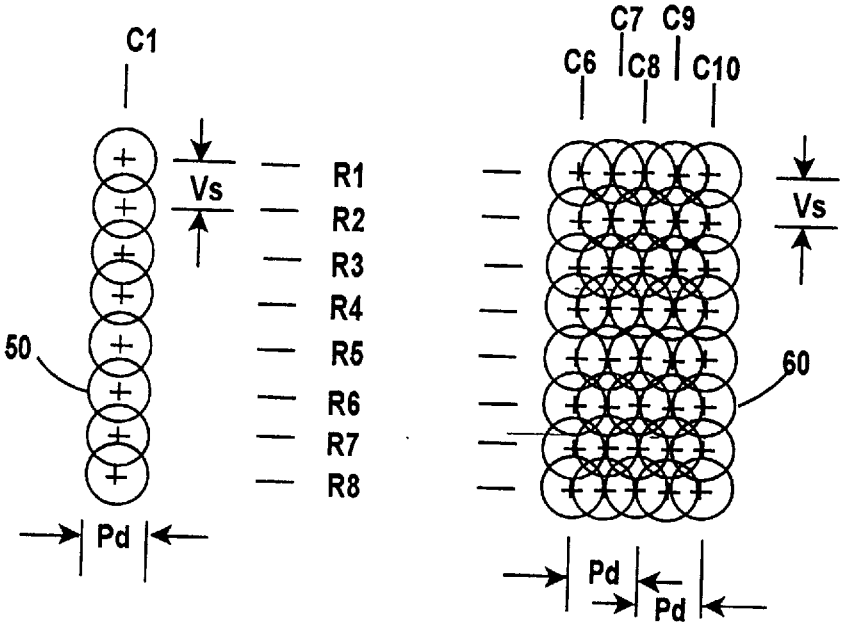
FIG. 4 is a diagrammatic presentation of a portion of a bar code created by the methodology of FIG. 3.

Referring now to FIGS. 3 & 4, the line or bar 50 is formed of 8 PELS, on centers Vs, or 1/72" (~0.014" or 0.353 mm) apart. This bar or line 50 is formed of 16 passes of the hammer or print head assembly 32. (Two passes for each line feed). Two passes of shuttle 32 are required in order to adequately fill the wide bar 60. As also shown in FIG. 4, a wide bar 60 is printed at the same time as the narrow bar. In FIG. 3, which is a modified plan view of the lines or bars 50 and 60, a space "S" is shown between the passes to help in visualization of the print effect. During the first pass, in row R1 assume that a dot is placed in columns C1, C6, C8, and C10 during the first pass. Note that the on center distance between adjacent PELS in columns C6–C8 is the PEL distance Pd, and the dots are shown just touching . During the second pass of the print head, still in row R1, dots are printed at columns C9 and C7. These form an overlap with the dots in columns C6, C8 and C9. (See row R1 in bar or line 60 for the effect of the overlap) and provide adequate fill for bar 60. A line feed of the distance Vs then takes place and a second row of dots is then placed in the same columns during the third and forth passes. The print process thus continues through rows R1–R8. I.e. two passes per row. When there is a need for an even greater amount of fill in the wide bar, and when higher addressability is available (180 PEL, 240 PEL, etc.) in a particular printer, a greater number of passes maybe required to complete a dot row.

Figure 9:
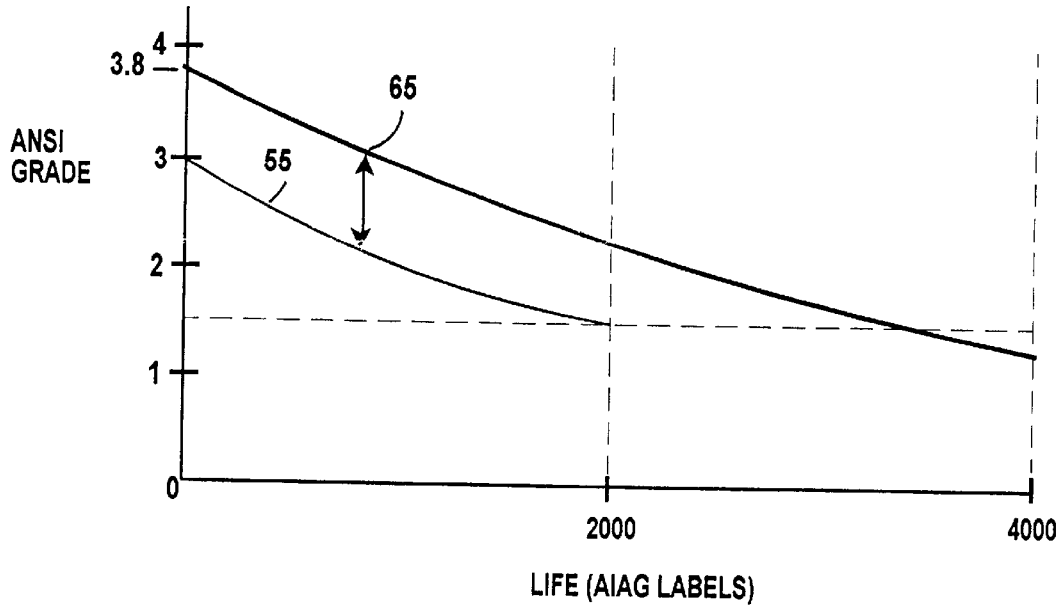
FIG. 9 is a chart depicting how the methods of the present invention may increase the life of a typical fabric ribbon normally employed for bar code printing over that of the prior art methods illustrated in FIGS. 3 & 4.

As is understood by those who design and use printers of this type, the ribbons carry a finite quantity of ink which will eventually get depleted by printing. However, before total ink depletion occurs, the acceptability of print output from a ribbon as it is used starts to degrade to the point where that output is no longer acceptable. When printing bar codes, that point is generally accepted to have been reached when the difference in contrast between the bar code lines and their interlineated spaces, is measured and the ribbon changed whenever the ANSI grade falls below a reading of ~1.5–2.0 and/or the print contrast signal falls below 0.70 PCS, levels at which bar code readings become questionable and error plagued when scanned. (To be conservative, an ANSI grade of 2.0 is normally the lower limit, although if the scanner is particularly good and the software employed is of high quality, it is practicable to allow the ANSI grade to lower to the lower limit of 1.5). Referring to FIG. 9, where ANSI grade is plotted against print life in the form of standard bar code labels, the standard print methodology as described with regard to FIGS. 1–4, (and shown as line 55) allows for approximately 2000 AIAG (Automotive Industry Action Group) labels to be printed (standard length ribbons) before bar code readings become questionable and error plagued when scanned, especially for the thin bars or lines like the line 50 in FIG. 4. Typically, for AIAG bar code labels, two passes are required to obtain adequate fill for the wide bars.

In accordance with the invention, the density of selected bar code lines of print is increased by one of the following techniques, increasing the number of PELS per inch of print in at least selected printed lines of bar code, or impacting the same print lines a greater number of times to increase the color density of at least selected dots in the print line. The increase in vertical PEL density, or alternatively, the increase in the number of times a line is impacted, is equal to the number of passes required to complete a dot row as described in FIGS. 3 and 4. The number of passes required to complete a dot row is determined by the adequacy of the fill of the wide bars and the addressability of the printer. Thus, the increase for the example in FIGS. 3 and 4 is twice.

It has been discovered that adding a single line of PELS to thin lines or bars increases and almost doubles the useable life of the print ribbon. Additionally, the bar code quality, in terms of its ANSI bar code grade improves significantly, to almost a full grade higher. Moreover, it has also been discovered, that because only a small extra amount of ink is depleted from the ribbon 10 when adding a single line of PELS as a supplement, the efficiency of and quality grade increase at the outset of printing, i.e. with a brand new ribbon, while increasing the ribbon life approximately the same amount, simultaneously enhances bar codes formed in an impact printer by increasing the density of the selected print bars or lines, e.g. thin lines or bars. Furthermore, by extending the useful life of the print ribbons, the efficiency of the printing operation is increased. (I.e, less down time for ribbon change, and lower cost of operation because of increased number of PELS printed per ribbon). Additionally, since two passes are required to adequately fill each wide bar of a bar code, there is no print throughput loss associated with taking advantage of the second pass to increase the optical density of the narrow bars.

Figure 5:
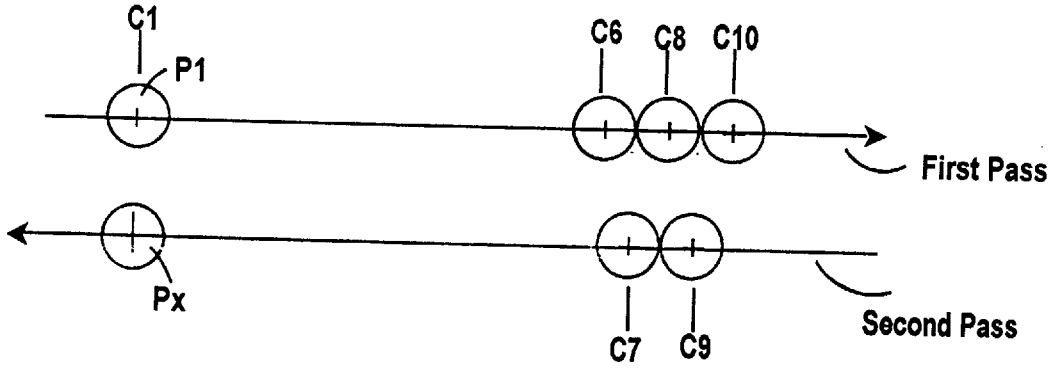
FIG. 5 is a diagrammatic presentation which depicts how a first technique of the present invention is applied to print bar codes in the FIG. 1 printer to enhance the print result and extend the life of a ribbon based upon end-of-life bar code grade measurements.
Figure 6:
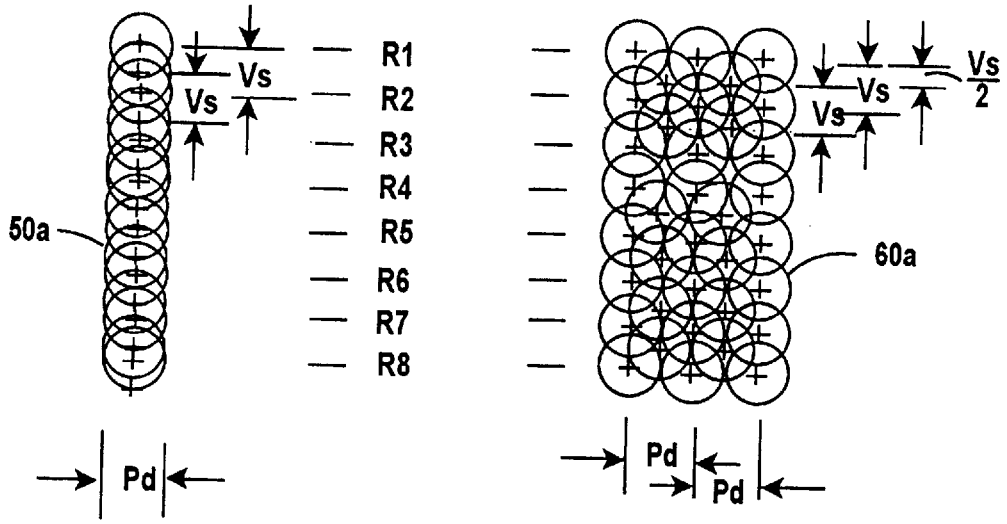
FIG. 6 is a diagrammatic presentation of a portion of a bar code created by the first novel technique of the present invention illustrated in FIG. 5.

To this end, and referring now to FIGS. 5 & 6, during each reciprocation (two passes) of the hammer or print head assembly 28, an extra PEL "Px" is printed in superimposed, overlapping relation with respect to the first printed dot. In the first or preferred method shown in FIGS. 5 & 6, intermediate the first and second pass of the hammer or print head assembly 28, the line feed increment for the paper feed drive motor is changed to ½ Vs so that the additional dot Px is printed with its center~on the circumference of the dot P1 printed on the first pass. Thus the line or bar 50 (FIG. 4) now forms a new line 50*a* (FIG. 6) of double the line density. Moreover, the only difference between the old method of printing and the new, from the standpoint of the wider line or bar 60 in FIG. 4, is the two dots in columns C7 and C9 are printed intermediate rows R1 and R2 (i.e. displace vertically ½ Vs) to form the wider line or bar 60*a*. This means that the dots in columns C7 and C9 are deposited in superimposed overlapping relation with the dots printed in columns C6, C8 and C10, no additional ink from the ribbon 10 is placed on the print receiving medium or paper 33 than would have been used in the prior method described with respect to FIGS. 3 and 4.

As previously mentioned, there is no printer throughput loss as a result of printing dot Px, since this is accomplished on the second pass required in any event to obtain adequate fill for the wide bars of a bar code. Again, for the case where higher PEL addressability exists in a printer and more passes are, therefore, required for adequate fill of wide bars, a proportionately greater number of paper increments (Vs/3, Vs/4, etc.) would be utilized.

Figure 7:
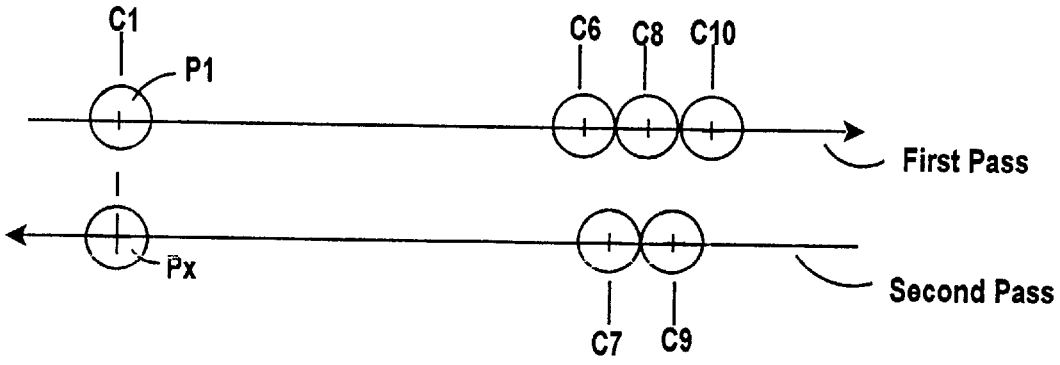
FIG. 7 is a diagrammatic presentation which depicts how a second technique of the present invention is applied to print bar codes in the FIG. 1 printer to enhance the print result and extend the life of a ribbon based upon end-of-life bar code grade measurement.
Figure 8:
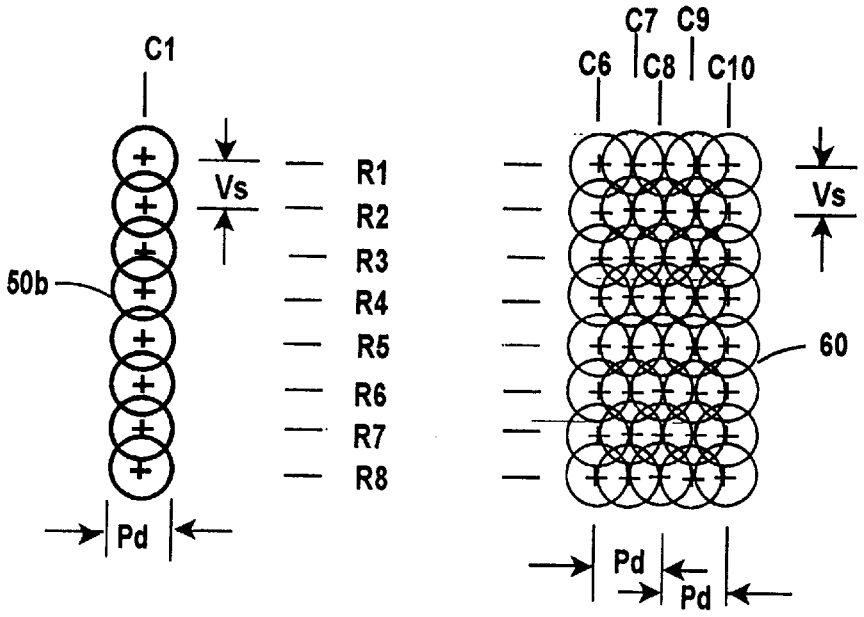
FIG. 8 is a diagrammatic presentation of a portion of a bar code created by the first novel technique of the present invention illustrated in FIG. 7.

In a second embodiment, and referring now to FIGS. 7 & 8, the added dot Px may be placed substantially on top of the first dot P1, with no line feed. Thus an enhanced or higher density printed line 50*b* is formed by overstriking or double striking the dot P1. Moreover, as the line 60 is still formed identically to that described with respect to FIG. 4, no additional ink depletion of the ribbon 10 occurs from the formation of the wider line than had occurred in the prior art method of printing. No printer throughput loss is incurred as a result of the overstrike of dot Px on to dot P1. Furthermore, if additional passes are required for wide bar fill, more overstrikes can be applied to the narrow bar.

Figure 10:
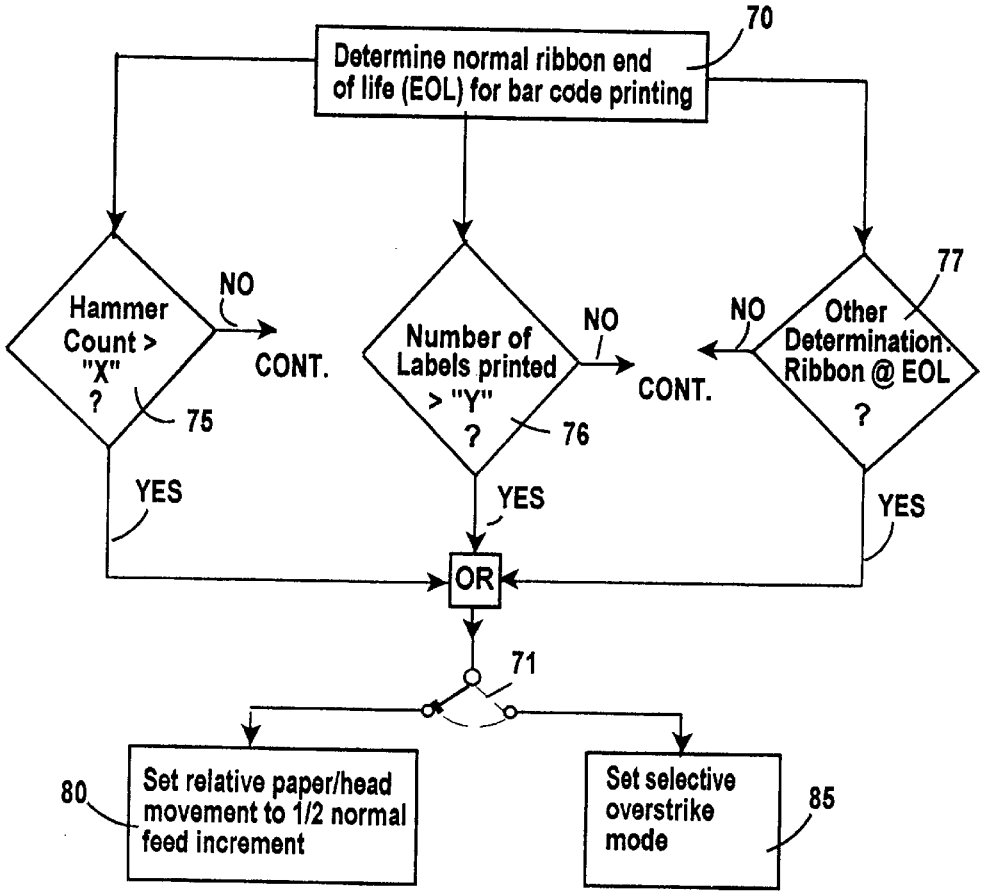
FIG. 10 is a flow chart of logic that may be employed to implement either or both of the techniques illustrated in FIGS. 5–8.

To further economize and extend ribbon life to its maximum, it is a simple matter to utilize the printer 5 in its normal or conventional printing mode (i.e. as described heretofore with respect to FIGS. 3 & 4), and switch to the improved printing mode upon the occurrence of a predetermined event. For example, and referring to FIG. 10, some statistical determination must first be made as to the normal ribbon end-of-life (EOL) for bar code printing. This can be established, as in FIG. 9, as the curve 55, for example. In the process, this would then be step 70. One excellent way in which the normal ribbon end of life may be determined, is to count hammer or pin impacts on the print ribbon (step 75, FIG. 10). When the number of impacts reaches a predetermined quantity "X", which of course will depend upon the print ribbon initial quality, its length etc. then the mode may be switched (as diagrammatically depicted by switch 71) to either the first or second inventive method (shown at logic step 80 and 85 respectively). Quantity "X" may occur in the range of 10,000,000 to 30,000,000 impacts, for example, with a good quality, 60 yard (~55 meters) in length, fabric ribbon. It is a simple matter to use this kind of test with a few simple lines of code with respect to the hammer logic control 30.

Another method to further economize and extend ribbon life to its maximum, if the bar code being printed is substantially the same or contains substantially uniform numbers of thin and thick lines (this is usually not true), is to count the number "Y" of labels printed before the normal ribbon EOL. As shown in logic step 76 in FIG. 10, when this number "Y" is exceeded, the mode may be switched, as diagrammatically depicted by switch 71, to either the first or second inventive method shown at logic steps 80 and 85 respectively.

Of course other methods to determine ribbon EOL may be employed (step 77) to effect a mode switch to increase the density of thin lines or bars. For example, a sample read scanner on the hammer or print head assembly 28 may be employed to scan a first label out of each sheet, or successive labels as they are printed, and compared with an existing standard to to determine whether the mode should be switched to one of the inventive methods. Moreover, inasmuch as it has been found that a single print overpass of thin lines is sufficient to increase thin bar density and thereby increase readability of the bar code printed for an extended ribbon life period of time, i.e. without appreciable shortening of ribbon print life, one of the embodiments of the invention, i.e. 80 or 85 may be set initially after the determination 70 is made.

Thus, the methodology of the present invention enhances the quality of bar codes formed in an impact dot matrix printer by increasing the density of selected print bars or lines, and increasing the efficiency of the printing operation by extending the useful life of print ribbons employed in the printer. Further, the methodology described has the added benefit of avoiding printer throughput loss.

Although the invention has been described with a certain degree of particularity, it should be recognized that elements thereof may be altered by person(s) skilled in the art without departing from the spirit and scope of the invention as hereinafter set forth in the following claims.

What is claimed is:

1. A method for printing bar code lines on a medium with an impact matrix printer including a print head capable of reciprocal movement, medium for receiving printed indicia and paper feed device for incrementally moving the medium orthogonally with respect to movement of the print head comprising operating the printer to reciprocate the print head and print on the medium in each direction without moving the medium and without printing adjacent addressable printing element locations and without overstriking except that lines which are only a single printing element in width are printed in each direction.

2. The method of claim 1 wherein the medium is moved by the paperfeed device after printing in each direction and printing is without any overstriking.

* * * * *